United States Patent [19]

Walker

[11] Patent Number: 4,908,616

[45] Date of Patent: Mar. 13, 1990

[54] TRAFFIC CONTROL SYSTEM

[76] Inventor: Jonothan P. Walker, 12206 E. 58th Ter., Kansas City, Mo. 64133

[21] Appl. No.: 255,326

[22] Filed: Oct. 11, 1988

[51] Int. Cl.[4] ..... G08G 1/096

[52] U.S. Cl. ..... 340/929; 340/916

[58] Field of Search ..... 340/929, 930, 907, 908, 340/916, 917, 932; 404/12, 15, 16

[56] References Cited

U.S. PATENT DOCUMENTS

| | | | |
|---|---|---|---|
| 2,016,220 | 1/1935 | Anderson | 340/929 |
| 2,457,512 | 12/1948 | Wheeler | 404/15 |
| 3,810,084 | 5/1974 | Hoyt, Jr. | 340/916 X |
| 4,200,860 | 4/1980 | Fritzinger | 340/929 |
| 4,371,863 | 2/1983 | Fritzinger | 340/929 |
| 4,590,455 | 5/1986 | Fritzinger | 340/907 |
| 4,847,618 | 7/1989 | Baustin | 340/929 |

FOREIGN PATENT DOCUMENTS

| | | | |
|---|---|---|---|
| 2711378 | 9/1978 | Fed. Rep. of Germany | 340/929 |
| 2596181 | 9/1987 | France | 340/929 |
| 2146372 | 4/1985 | United Kingdom | 404/16 |

*Primary Examiner*—Joseph A. Orsino
*Assistant Examiner*—Brian R. Tumm
*Attorney, Agent, or Firm*—Litman, McMahon & Brown

[57] ABSTRACT

A system for controlling traffic at a street intersection includes an intersection signal light assembly with a flashing green signal light unit, in addition to the usual red, yellow and green signal light units. A signal controller is provided for the intersection signal light assembly and actuates the flashing green signal light unit during flashing green intervals that precede green intervals in which the green signal light unit of the intersection signal light assembly is actuated. A pre-intersection signal light assembly is located in proximity to a reaction point associated with an approach lane to the intersection. The distance that the reaction point is located from the intersection is determined by considering the reaction time of a driver and the stopping distance of a vehicle in which the vehicle could be safely brought to a stop at the intersection. The pre-intersection signal light assembly is for providing a reference point beyond which a driver should clear the intersection if the flashing green interval commences and before which the driver should stop upon commencement of the flashing green interval. A method of controlling traffic with the traffic control system is also disclosed.

8 Claims, 2 Drawing Sheets

TRAFFIC CONTROL SYSTEM

BACKGROUND OF THE INVENTION

1. Field of the Invention

The present invention relates generally to traffic control systems, and in particular to a method and apparatus for providing a driver with information concerning an imminent traffic signal change and the driver's distance from the intersection.

2. Description of the Prior Art

Traffic control systems have heretofore been associated with a wide variety of vehicle traffic conditions. The objectives of such systems generally include safety and transportation efficiency. In efforts to achieve such objectives, intersections which are traversed by vehicles have heretofore been provided with various traffic control systems. Stop signs and yield signs are often employed at relatively low-volume intersections. Intersections with greater volumes of traffic are often provided with traffic signals, which may comprise traffic light assemblies including individual signal light units having different colors and configurations for controlling traffic.

In the United States, such traffic control devices are governed by the Manual on Uniform Traffic Control Devices (MUTCD). In most jurisdictions compliance with the various traffic control systems is required by law. Furthermore, the requirements placed on motorists by certain traffic control systems are almost universal. For example, a continuous red light at an intersection normally prohibits entry into the intersection until the red light is replaced by a green light, at which time the motorist can proceed through the intersection. Normally, a yellow light is displayed after the green light interval and before the red light interval for the purpose of warning motorists that only a limited time remains to traverse the intersection before cross traffic will be permitted to enter the intersection pursuant to a green signal.

The yellow light interval is normally long enough to permit a motorist to either: (1) clear the intersection before the red light interval; or (2) stop before entering the intersection. Thus, if a motorist is in or very near the intersection when the yellow signal appears, he or she can probably traverse the intersection at normal traffic speed. On the other hand, a stop is indicated if the motorist is some distance from the intersection at the beginning of the yellow light interval.

Although the traffic control system described above is in common use throughout the United States and in many other parts of the world, it has a serious disadvantage which has contributed to many intersection collisions. A "dilemma zone" exists at a distance from the intersection whereat, upon actuation of the yellow signal, the motorist could conceivably either stop before the intersection or proceed through it before the red light interval. Upon encountering a yellow signal in the dilemma zone, a motorist must quickly (i.e., in a few seconds or less) decide whether to proceed or stop. The ability of a vehicle to stop or clear an intersection upon encountering a yellow light in the dilemma zone depends upon a number of factors including: (1) the driver's reaction time; (2) the breaking performance of the vehicle; (3) the speed of the vehicle; (4) the acceleration performance of the vehicle; (5) the road surface coefficient of friction; (6) the grade (i.e., incline, flat or decline); and (7) the distance from the intersection. All of these factors must be quickly taken into account and the proper decision reached to avoid making one of the following two mistakes: (1) trying unsuccessfully to stop before reaching the intersection; and (2) trying unsuccessfully to clear the intersection before the red interval. Numerous vehicular accidents have been attributed to both types of mistakes.

To reduce the hazards associated with the dilemma zone, it has heretofore been proposed to lengthen the yellow light interval and also to provide an interval between the commencement of the red light interval for traffic in one direction and the green light interval for cross traffic. Although both of these proposals may have some positive safety effect, they tend to contribute to inefficiencies in traffic flow because more vehicles are kept waiting longer at intersections. Furthermore, aggressive drivers may anticipate longer yellow light intervals and drive accordingly, often by accelerating when the yellow interval commences. A particularly dangerous situation occurs at an intersection where one driver is accelerating to clear the intersection during a yellow light interval and a cross traffic driver attempts to enter the intersection immediately upon or even prior to the commencement of his or her green light interval.

The present invention addresses the safety and efficiency problems of prior art traffic control systems.

SUMMARY OF THE INVENTION

A traffic control system is provided for an intersection of two streets, each including at least one approach lane. The system includes an intersection signal light assembly with red, yellow, green and flashing green signal light units. The intersection signal light assembly is connected to a signal controller that actuates the signal light units intermittently.

A pre-intersection signal light assembly is located adjacent to a reaction point associated with an approach lane. The reaction point distance from the intersection is determined by considering the distance a vehicle would travel during a reaction time interval and the distance required to stop the vehicle in a stopping interval. In addition to the pre-intersection light signal assembly, other signalling means, such as a rumble strip, may be provided in the approach lane in proximity to the reaction point.

A method of controlling traffic with the traffic control system is disclosed and includes the step of actuating the flashing green signal light unit for a flashing green interval immediately preceding a green interval during which the green light is actuated. The method also includes the steps of determining the reaction point distance and locating a pre-intersection signal means, including the signal light assembly and the rumble strip, thereat.

Heretofore there has not been available a traffic control system or method with the advantages and features of the present invention.

OBJECTS AND ADVANTAGES OF THE INVENTION

The principal objects and advantages of the present invention include: providing a traffic control system; providing such a system which is readily adaptable to existing traffic control systems; providing such a system which is particularly designed for use in connection with intersections; providing such a system which can reduce the hazards associated with intersections; providing such a system which includes an intersection signal light assembly compatible with existing intersection signal light assemblies; providing such a system which can be controlled by existing signal controllers with relatively minor modifications; providing such a system which assists drivers with deciding whether or not to proceed through a controlled intersection; providing such a system which may reduce property damage and personal injury at intersections; providing such a method of controlling traffic; providing such a method wherein a flashing green light signal is provided immediately prior to a yellow signal; providing such a method which assists motorists in complying with traffic laws; providing such a method which assists law enforcement officials in enforcing traffic laws; and providing such a system and method which are efficient in operation, economical to manufacture and implement and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Background and Environment

Figure 1:
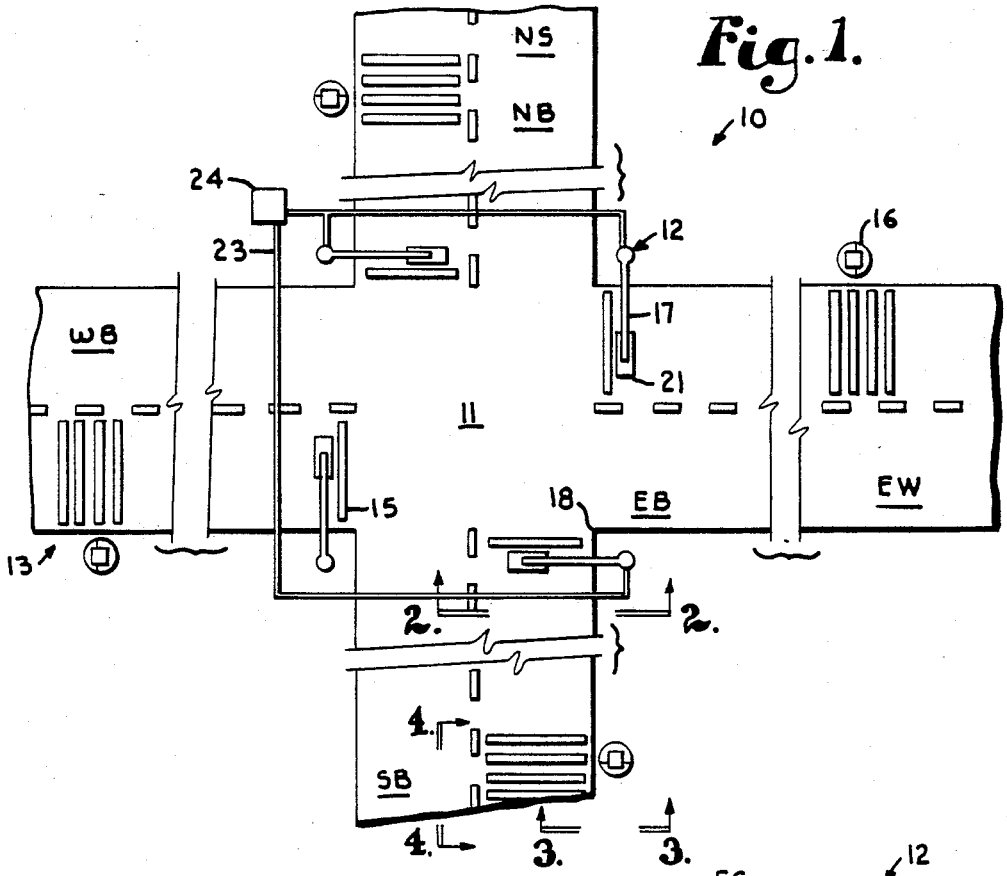
FIG. 1 is a schematic, plan view of a pair of streets and their intersection with a traffic control system embodying the present invention. sectional view of the traffic control system taken generally along line 2—2 in FIG. 1 and particularly showing an intersection signal light assembly.
Figure 2:
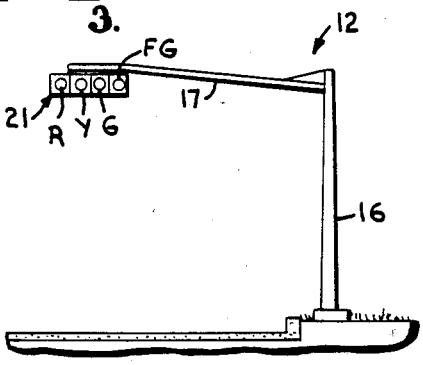
Figure 3:
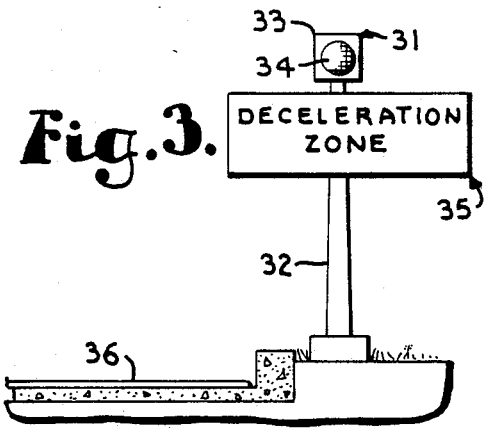
FIG. 3 is an enlarged, fragmentary, vertical cross-sectional view of the traffic control system taken generally along line 3—3 in FIG. 1 and particularly showing pre-intersection signal means.
Figure 4:
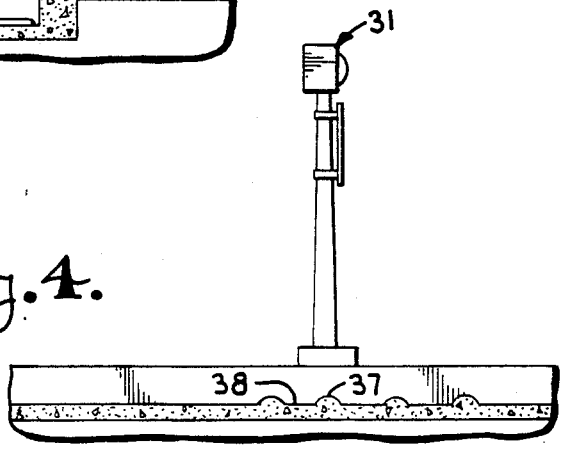
FIG. 4 is an enlarged, fragmentary, vertical cross-sectional view of the traffic control system taken generally along line 4—4 in FIG. 1 and particularly showing the pre-intersection signal light assembly.
Figure 5:
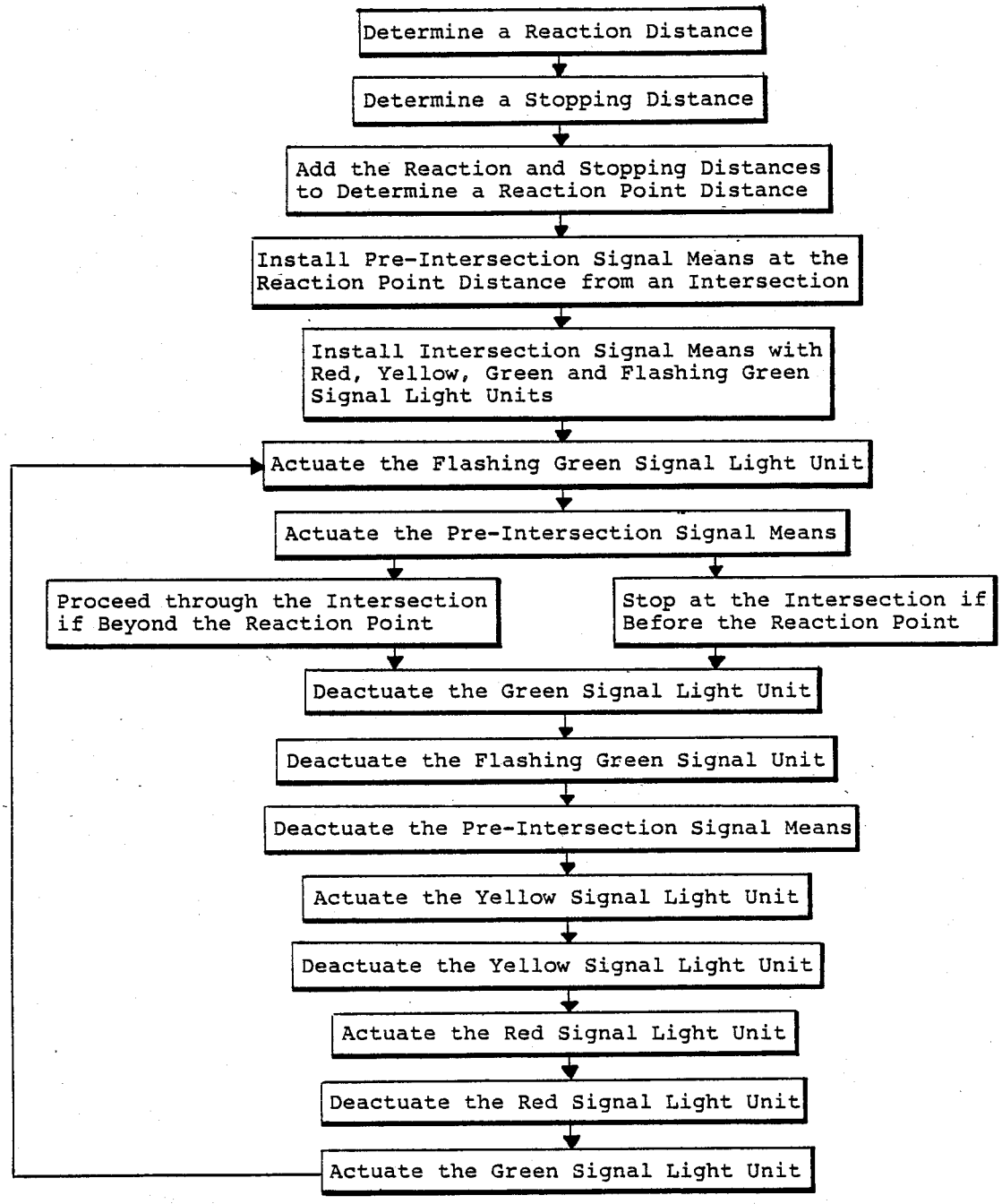
FIG. 5 is a flow diagram showing a traffic control method embodying the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 10 generally designates a traffic control system embodying the present invention. The traffic control system 10 is associated with a ninety-degree intersection 11 of a north-south street NS with northbound and southbound approach lanes NB, SB, and an east-west street EW with eastbound and westbound approach lanes EB, WB. Four corners 18 are formed by the intersection 11. Each lane NB, SB, EB and WB includes a respective stop bar 15 in proximity to the intersection 11. Although a ninety-degree intersection of a pair of two-lane streets NS, EW ss described, the present invention may be used on various other types of intersections, such as street/crosswalk, street/railroad, street/drawbridge, T-intersections, etc. Furthermore, although two-lane streets NS, EW are described, application of the present invention in practically any conveyance medium is contemplated and within the scope of the present invention. For example, a railroad might employ the traffic control system of the present invention in connection with a section of track along which a train might be required to stop according to some prearranged signal.

The traffic control system 10 generally includes an intersection signal means 12 and a pre-intersection or dilemma zone signal means 13.

II. Intersection Signal Means

In the illustrated embodiments of the present invention, an intersection signal means 12 and a pre-intersection signal means 13 are provided for each of the intersecting approach lanes NB, SB, EB and WB. Each intersection signal means 12 includes a vertical standard or pole 16 anchored securely in proximity to a respective corner 18 of the intersection 11. A substantially horizontal crossbeam 17 extends from the standard or pole 16 over a respective approach lane NB, SB, EB or WB. Suspended from the crossbeam 17 is an intersection signal light assembly 21 with red, yellow (amber), green and flashing green signal light units R, Y, G and FG. The intersection signal light assemblies 21 are connected by cables 23 to a signal controller 24, which may also be placed in proximity to the intersection 11 as shown, or may be at a location remote therefrom.

The signal controller 24 may include a timer for actuating the red, yellow, green and flashing green signal light units R, Y, G and FG for predetermined intervals each. The timer of the signal controller 24 can be adapted to cause the flashing green interval to operate at least partly concurrently with the green interval. Alternatively, the signal controller 24 may respond to conditions at or near the intersection 11, such as the presence or absence of traffic on the streets NS and NW. Still further, the signal controller may respond to conditions remote from the intersection 11. For example, signal controllers 24 at various intersections throughout a given area can be linked to a master control system for regulating traffic throughout the area. The signal controller 24 may include a programmable computer capable of executing instructions in response to predetermined signal input.

III. Pre-Intersection Signal Means

The pre-intersection signal means 13 may be located in proximity to a dilemma zone 27 associated with a respective street lane NB, SB, EB or WB. In the traffic control system 10 comprising a preferred embodiment of the present invention, the pre-intersection signal means 13 includes two independent signal means, a signal light assembly 31 and a rumble strip 36.

The pre-intersection signal light assembly 31 includes a vertical standard 32 which may be suitably anchored to the right (as viewed by the drivers approaching the intersection) of a respective lane NB, SB, EB or WB. A signal light unit 33 is mounted on the vertical standard 32 and faces oncoming traffic. A sign 35 is mounted on the vertical standard 32 below the light subassembly 33 and also faces oncoming traffic. The sign 35 may contain appropriate instructions to oncoming motorists, such as "Stop on Yellow" or the like. The signal light unit 33 may be connected to the signal controller 24 and may either flash, operate intermittently or operate continuously.

The rumble strip 36 comprises a plurality of alternating lands 37 and grooves 38 extending transversely across a respective lane NB, SB, EB or WB. The rumble strip 36 may be located adjacent the pre-intersection signal light assembly 31.

IV. Installation Method

The location of the pre-intersection signal means 13 may be established to facilitate safety and efficiency. The pre-intersection signal means 13 may be located a distance greater than or equal to the reaction point distance RPD as measured from a respective stop bar 15 to a respective reaction point RP.

The reaction point distance RPD is based upon the stopping sight distance (SSD) formula, which is the sum of two distances: (1) the distance the vehicle travels while the driver responds; and (2) the distance the vehicle travels while the driver stops it. The RPD can be calculated as follows:

$$RPD = 1.47\,PV + \frac{V^2}{30\,(f \pm g)}$$

Where:

RPD=reaction point distance in feet
P=perception—reaction time in seconds
V=85th percentile speed of approach traffic in miles per hour
f=co-efficient of friction for wet pavement
g=percent of grade divided by 100 (added for upgrade and subtracted for downgrade)

The interval during which the pre-intersection means 13 is actuated is referred to as the FGI for "flashing green interval", and may be calculated with the following formula:

$$FGI=(RPD)/(1.47V)$$

The above formulae for calculating the RPD and the FGI are exemplary and should be regarded as guidelines only. Actual RPD and FGI values for a particular intersection or other installation may also be determined empirically and may take into account conditions that are unique to a particular installation or responsive to particular traffic conditions and traffic planning objectives.

The traffic control system 10 is designed for installation with minimum modifications to existing intersection traffic control systems. Thus, the traffic control system 10 can be implemented by: (1) installing the signal light unit FG on the existing intersection signal light assemblies 21; (2) extending wiring from the signal light units FG to the signal controller 24; (3) providing a 26 flasher unit in the signal controller 24 to selectively cause the signal light units FG to flash; (4) providing a new signal switch cam for an electro-mechanical controller 24 or new actuation circuitry for an electrical controller; and (5) installing the pre-intersection signal light assemblies 31. For a signal controller with a computer or microprocessor, appropriate software could be provided to integrate the function of the signal light units FG with the remaining functions of the intersection signal light assembly.

A method of installing the traffic control system 10 is also provided wherein the system 10 is actuated by vehicles approaching the intersection 11. To implement this method vehicle detectors are provided in the streets NS and EW as needed to provide the control system 10 with appropriate information to actuate the signal light units FG.

V. Operation

A method of operating the traffic control system 10 is disclosed which includes the steps of providing a motorist with a reaction point RP signal before the motorist reaches the intersection 11. The signal may be provided by the pre-intersection signal means 13, and may comprise a visual signal from the pre-intersection signal light assembly 31 or a signal from the rumble strip 36 which is heard and felt. Either way, or both ways, the driver perceives a signal from the pre-intersection signal means 13 which indicates that the driver is at a reaction point distance RPD from a respective stop bar 15 at the intersection 11. If the signal light unit FG is actuated, the driver makes a simple determination of whether or not he or she was within the reaction point distance RPD when the signal light unit FG was first actuated.

If the driver has not yet passed the reaction point RP when the signal light unit FG is actuated, he or she should commence stopping procedures and bring the vehicle to a halt before a respective stop bar 15. On the other hand, if the driver has passed the reaction point RP when the flashing green interval commences, and is traveling at a velocity within the eighty-fifth percentile speed of approach traffic to the intersection 11, he or she can safely clear the intersection 11 and should normally proceed.

The traffic control system 10 may help to promote safe and efficient vehicular transportation by eliminating some of the guesswork associated with the dilemma zone. The traffic control system 10 can reduce the collision hazards associated with an intersection by providing motorists with reliable information upon which to base a decision whether to stop or proceed at an intersection which is about to undergo a signal change.

The benefits of the traffic control system 10 may be enhanced if compliance with its method of operation is required by law. For example, motorists could be required by law to commence stopping procedures upon actuation of the pre-intersection signal light assembly 31 before their vehicles had reached the reaction point RP. Although many types of intersections may benefit from the traffic control system 10, it may be most beneficial at high speed, high volume and hazardous intersections.

It is to be understood that while certain forms of the present invention have been illustrated and described herein, it is not to be limited to the specific forms or arrangement of parts described and shown.

What is claimed and desired to be secured by Letters Patent is as follows:

1. A traffic control system for a street intersection, which comprises:

(a) intersection signal means for intermittently signalling an imminent stop signal associated with the intersection;

(b) pre-intersection signal means associated with a reaction distance from said intersection;

(c) signal control means adapted for selectively energizing said intersection signal means in response to a predetermined condition;

(d) said predetermined condition for causing said signal control means to actuate said intersection signal means comprising a predetermined time interval; and (e) said intersection signal means including red, yellow, green and flashing green signal light units.

2. The traffic control system defined in claim 1 wherein said pre-intersection signal means includes a signal light assembly.

3. The traffic control system defined in claim 1 wherein:

(a) said pre-intersection signal means comprises a ridge extending transversely across at least a portion of said street.

4. The traffic control system defined in claim 1 wherein:

(a) said flashing green signal light unit is actuated by said control means for a flashing green interval;

(b) said yellow signal light unit is actuated by said control means for a yellow interval; and (c) said flashing green interval immediately precedes said yellow interval.

5. The traffic control system defined in claim 4 wherein:

(a) said green signal light unit is actuated for a green interval; and (b) said flashing green interval is at least partly concurrent with said green interval.

6. A method of controlling traffic along an approach lane of a street in the area of an intersection, which includes the steps of:

(a) providing green, flashing green, yellow and red intervals wherein green, flashing green, yellow and red signal light units respectively are actuated;

(b) determining a reaction point located a reaction point distance RPD from said intersection substantially according to the following formula:

$$RPD = 1.47\,PV + \frac{V^2}{30\,(f \pm g)}$$

Where:

RPD = reaction point distance in feet

P = perception—reaction time in seconds

V = 85th percentile speed of approach traffic in miles per hour f = co-efficient of friction for wet pavement g = percent of grade divided by 100 (added for upgrade and subtracted for downgrade)

(c) locating a pre-intersection signal light assembly in proximity to said reaction point; and (d) actuating said pre-intersection signal light assembly.

7. The method defined in claim 6, which includes the additional steps of:

(a) detecting a vehicle on a cross street in proximity to said intersection; and (b) actuating said flashing green signal light unit and said pre-intersection signal light assembly in response to said vehicle.

8. A traffic control system for an intersection of first and second streets with respective approach lanes to the intersection, the control system including an intersection signal light assembly including red, yellow and green signal light units and a signal controller for sequentially actuating said signal light units, which comprises:

(a) a flashing green signal light unit associated with said red, yellow and green signal light units;

(b) control means associated with said signal controller for actuating said flashing green signal light unit for a predetermined flashing green interval immediately preceding a predetermined green interval wherein said green signal light unit is actuated;

(c) a reaction point associated with each said approach lane to said intersection and positioned a reaction point distance therefrom derived substantially according to the following formula:

$$RPD = 1.47\,PV + \frac{V^2}{30\,(f \pm g)}$$

Where:

RPD = reaction point distance in feet

P = perception—reaction time in seconds

V = 85th percentile speed of approach traffic in miles per hour f = co-efficient of friction for wet pavement g = percent of grade divided by 100 (added for upgrade and subtracted for downgrade)

(d) pre-intersection signal means located in proximity to said reaction point and including:

(1) a pre-intersection signal light assembly with a vertical standard anchored adjacent a respective intersection approach lane and a pre-intersection signal light unit mounted on said vertical standard and facing oncoming traffic in said approach lane;

(2) said pre-intersection signal light unit being operably connected to said signal controller for selective actuation when said flashing green signal light unit is operating; and (3) a rumble strip comprising a plurality of alternating lens and grooves extending transversely across said lane in proximity to said reaction point.

* * * * *